US005945226A

United States Patent [19]

Harayama et al.

[11] Patent Number: 5,945,226

[45] Date of Patent: Aug. 31, 1999

[54] CHROMIUM ALLOY PLATING FILM, PLATING METHOD THEREOF AND MEMBER COVERED WITH SAID FILM

[75] Inventors: Akira Harayama; Hachiro Tanaka, both of Okaya, Japan

[73] Assignee: Teikoku Piston Ring Co., Ltd., Tokyo, Japan

[21] Appl. No.: 08/986,317

[22] Filed: Dec. 5, 1997

[30] Foreign Application Priority Data

Dec. 12, 1996 [JP] Japan ..... 8-352157

[51] Int. Cl.[6] ..... B32B 15/00

[52] U.S. Cl. ..... 428/666; 428/667

[58] Field of Search ..... 428/666, 667

[56] References Cited

U.S. PATENT DOCUMENTS 4,810,336 3/1989 Martyak ..... 204/51

FOREIGN PATENT DOCUMENTS 49-40774 11/1974 Japan .

OTHER PUBLICATIONS

The Journal of the Surface Finishing Society of Japan vol. 21 (1970), No. 7, p. 356, No month available.

The Journal of the Surface Finishing Society of Japan vol. 40 (1989), No. 3, p. 387, No month available.

Database WPI, Section Ch, Week 7448, Derwent Publications Ltd., London, GB; AN 74–83688V XP002060280 & JP 49 040 774 B (Nissan Motor Co Ltd) *abstract*, Nov. 1974.

*Primary Examiner*—Kishor Mayekar

*Attorney, Agent, or Firm*—Armstrong, Westerman, Hattori, McLeland, & Naughton

[57] ABSTRACT

A chromium alloy plating film is covered on the surface of sliding members and corrosion resistant members. The chromium alloy plating film is a Cr—Mo—I type alloy plating film containing iodine in 0.1 to 1.4 percent by weight and molybdenum in 0.4 to 3.8 percent by weight.

3 Claims, 8 Drawing Sheets

CHROMIUM ALLOY PLATING FILM, PLATING METHOD THEREOF AND MEMBER COVERED WITH SAID FILM

BACKGROUND OF THE INVENTION

1. Technical Field of the Invention

This invention relates to chromium alloy plating containing molybdenum and iodine (hereafter Cr—Mo—I type alloy plating). This chromium alloy plating film is ideal for use on sliding members and corrosion resistant members because of superior heat resistance, wear resistance, corrosion resistance and corrosion-wear resistance properties.

2. Description of the Related Art

Hard chromium plating is used in cylinder liners and piston rings in internal combustion engines. This hard chromium plating film can be used only in a limited atmosphere since the plating softens at hot temperatures in excess of 200° C. causing wear resistance to decrease and the plating itself dissolves due to sulfuric and hydrochloric acid.

Hard chromium plating is regarded as chromium-hydrogen type alloy plating. The hydrogen in the hard chromium plating imparts hardness. However, this hydrogen is discharged at high temperatures bringing about a resultant drop in hardness and wear resistance.

On the other hand, chromium alloy plating containing molybdenum (hereafter Cr—Mo type alloy plating) was proposed to improve the heat resistance, wear resistance and corrosion resistance of the chromium plating film (Japanese Patent Publication No. 44-73574, The Journal of the Surface Finishing Society of Japan (Vol. 21 (1970), No.7, Page 356, or The Journal of the Surface Finishing Society of Japan Vol. 40 (1989), No.3, Page 387).

However, follow-up testing revealed these alloy platings were difficult to reproduce and the electric current efficiency was below 3 percent (plating speed less than 4 $\mu$m/Hr) and could not be manufactured economically.

SUMMARY OF THE INVENTION

It is an object of this invention to provide a chromium alloy plating having heat resistance, wear resistance and corrosion resistance superior to hard chromium plating. A further object of this invention is to provide a chromium alloy plating of high electric current efficiency.

In the process of searching for a new Cr—Mo type alloy plating, the inventors discovered a Cr—Mo—I type alloy plating with heat resistance, wear resistance and corrosion resistance superior to that of conventional hard chromium plating and at the same time providing high electric current efficiency. In this invention, iodine has been added to the chromium alloy plating in order to provide high electric current efficiency.

In other words, the chromium alloy plating film of this invention contains iodine in 0.1 to 1.4 percent by weight and molybdenum in 0.4 to 3.8 percent by weight.

Molybdenum which is a main constituent of the chromium alloy plating of this invention provides heat resistance, wear resistance and corrosion resistance.

When the molybdenum content is less than 0.4 percent, the corrosion resistance of the chromium alloy plating film becomes unsatisfactory. Also, when the molybdenum content is larger than 3.8 percent, the electric current efficiency of the chromium alloy plating becomes too low.

Iodine which is also a main constituent of the chromium alloy plating of this invention serves as a catalyst during the chromium alloy plating to improve electric current efficiency and precipitates along with the chromium and molybdenum bringing about resultant heat resistance.

When the iodine content is below 0.1 percent, the molybdenum content reaches saturation level. Further, when the iodine content exceeds 1.4 percent, the adequate molybdenum is not obtained.

A preferred range for the iodine and molybdenum content is 0.1 to 0.9 percent for iodine and 0.5 to 2.5 percent for molybdenum.

The chromium alloy plating film of this invention can be obtained by utilizing a plating bath containing iodine of 0.1 to 1.4 percent by weight and molybdenum of 5 to 35 percent by weight, based on $CrO_3$ present, within a temperature range of 20 to 70° C.

BRIEF DESCRIPTION OF THE DRAWINGS

The aforesaid and other objects and features of the present invention will become more apparent from the following detailed description and the accompanying drawings.

DESCRIPTION OF THE PREFERRED EMBODIMENTS

Figure 1:
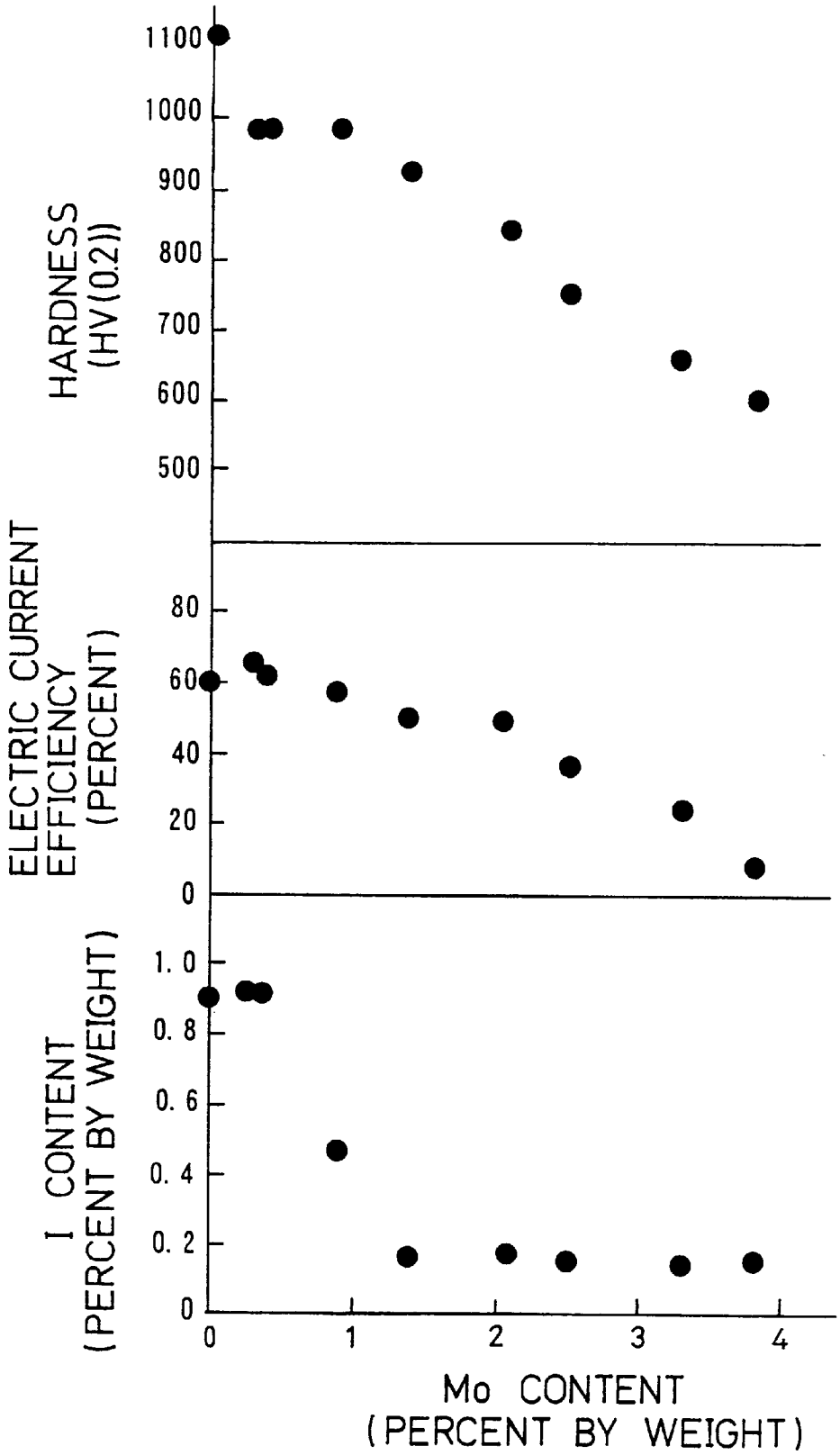
FIG. 1 is a graph showing the interrelation of iodine content, hardness and electric current efficiency versus molybdenum content in the chromium alloy plating film.

The chromium alloy plating film of this invention is a Cr—Mo—I type alloy plating film containing iodine in 0.1 to 1.4 percent by weight and molybdenum in 0.4 to 3.8 percent by weight. The chromium alloy plating film of this invention can be obtained under the following conditions.

(1) Plating bath:

$CrO_3$: 400–900 g/l $Cl^-$: 5–15 g/l $IO_3^-$: 2–8 g/l $F^-$: 0–3.5 g/l $MoO_4^{--}$: 50–450 g/l (2) Plating temperature: 20–70° C.

(3) Electric current density: 40–80 A/dm$^2$

In the above plating bath, $IO_3^-$ has been added in the form of iodic acid ($HIO_3$) or iodate ($KIO_3$, $NaIO_3$, etc.). Also, $MoO_4^{--}$ has been added in the form of molybdate ($Na_2MoO_4.2H_2O$, $(NH_4)_6Mo_7O_{24}.4H_2O$, etc.).

In the above mentioned plating bath, $Cl^-$ has the effect of widening the luster area of the plating, while $F^-$ has the effect of increasing the adhesion of the plating film. $F^-$ may be added in the form of KF, NaF, $H_2SiF_6$, or $K_2SiF_6$.

The characteristics of the plating surface of the Cr—Mo—I type alloy plating film obtained under the conditions shown below in (A) are shown in Table 1 (crack status) and in Table 2 (plating surface luster).

Plating conditions (A)

(1) Plating bath:

$CrO_3$: 800 g/l

HCl: 10 g/l $KIO_3$: 4 g/l

KF: 1.5 g/l $Na_2MoO_4.2H_2O$: 700 g/l maximum (2) Plating temperature: 20 to 70° C.

(3) Electric current density: 40 to 80 A/dm$^2$

TABLE 1

| $Mo/CrO_3$ weight ratio | Plating Temperature ° C. 20 | 30 | 40 | 50 | 60 | 70 |
|---|---|---|---|---|---|---|
| 0.05 | | | | | | ○ |
| 0.08 | | | | ○ | ○ | ○ |
| 0.12 | | | ○ | | | |
| 0.16 | ○ | | ○ | | ○ | |
| 0.18 | | ○ | | ○ | | |
| 0.25 | ○ | | | | ○ | |
| 0.35 | | ○ | | ○ | | |

Note:
The symbol ● indicates large crack density.
The symbol □ indicates small crack density.
The symbol ○ indicates no cracks.

TABLE 2

| $Mo/CrO_3$ weight ratio | Plating Temperature ° C. 20 | 30 | 40 | 50 | 60 | 70 |
|---|---|---|---|---|---|---|
| 0.05 | □ | □ | □ | □ | Δ | Δ |
| 0.08 | □ | □ | ○ | Δ | Δ | ◆ |
| 0.12 | ○ | ○ | Δ | ◆ | ● | |
| 0.16 | Δ | Δ | Δ | ◆ | ● | |
| 0.18 | Δ | | ◆ | ● | | |
| 0.25 | Δ | Δ | ◆ | ● | | |
| 0.35 | ◆ | ◆ | ◆ | ● | | |

Note:
The symbol □ indicates luster.
The symbol ○ indicates semi-lustrous.
The symbol Δ indicates whitish.
The symbol ◆ indicates grayish.
The symbol ● indicates blackish.

Table 1 and Table 2 reveal the following. At a plating temperature of 60° C. or more, or $Mo/CrO_3$ of 0.16 or more, the plating has no cracks and the plating particles are fine. Also, when $Mo/CrO_3$ is low and the temperature is low, a luster is obtained, and when $Mo/CrO_3$ is high and the temperature is high, a blackish, non-lustrous appearance is obtained.

Table 3 shows the molybdenum content, iodine content, hardness and electric current efficiency in the chromium alloy plating film obtained under the above mentioned plating conditions (A) with a plating temperature however of 40° C.

The molybdenum content and the iodine content were measured by EPMA.

TABLE 3

| $Mo/CrO_3$ weight ratio | Temperature ° C. | Electric current density A/dm$^2$ | Efficiency % | Hardness HV | I wt % | Mo wt % |
|---|---|---|---|---|---|---|
| 0 | 40 | 80 | 60.4 | 1110 | 0.91 | 0 |
| 0.04 | 40 | 80 | 66.6 | 980 | 0.93 | 0.3 |
| 0.05 | 40 | 80 | 63.0 | 980 | 0.92 | 0.4 |
| 0.08 | 40 | 80 | 58.0 | 980 | 0.47 | 0.89 |
| 0.12 | 40 | 60 | 50.9 | 920 | 0.16 | 1.37 |
| 0.16 | 40 | 50 | 50.3 | 840 | 0.17 | 2.07 |
| 0.18 | 40 | 45 | 37.2 | 750 | 0.15 | 2.50 |
| 0.25 | 40 | 40 | 24.2 | 660 | 0.14 | 3.30 |
| 0.35 | 40 | 40 | 8.1 | 600 | 0.15 | 3.80 |

The interrelations of the hardness, electric current efficiency and iodine content versus the molybdenum content in the chromium alloy plating film in Table 3 are shown in a graph in FIG. 1. As FIG. 1 clearly shows, the iodine content in the Cr—Mo—I type alloy plating film decreases as the molybdenum content is increased. However, at a molybdenum content of about 1.3 percent or more, the iodine content reaches a fixed value of about 0.15 percent. A Vickers hardness in the range of HV980 to 600 was obtained and this hardness showed a tendency to decrease as the molybdenum content is increased. If the $KIO_3$ amount is increased under the above mentioned (A) plating conditions, then the iodine content can be increased to 1.4 percent. Further, if the $KIO_3$ amount is decreased, then the iodine content can be reduced down to 0.1 percent.

Figure 2:
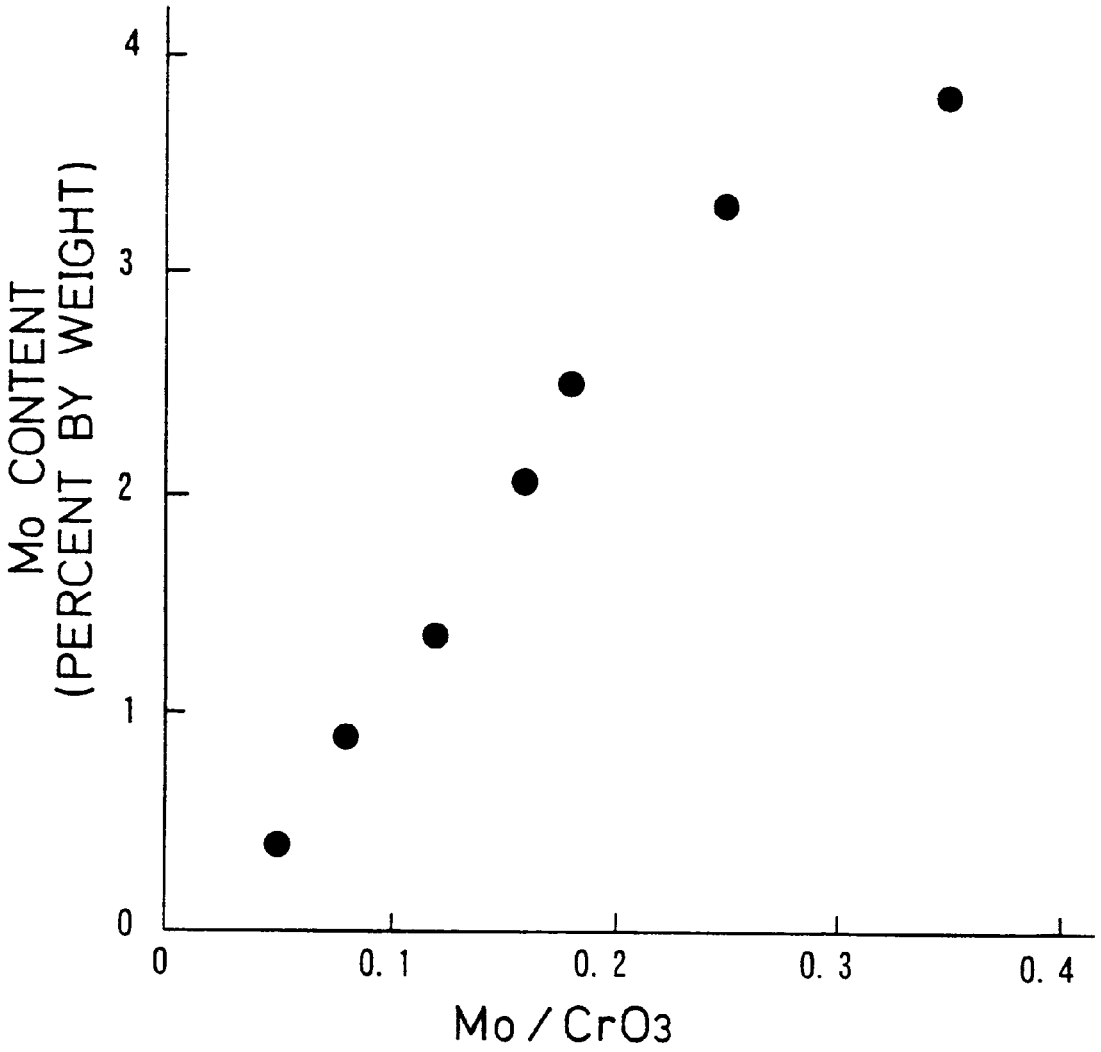
FIG. 2 is a graph showing molybdenum content in the chromium alloy plating film versus $Mo/CrO_3$.

The interrelation of the molybdenum content in the Cr—Mo—I type alloy plating film versus the $Mo/CrO_3$ in Table 3 is shown in a graph in FIG. 2. As clearly shown in FIG. 2, when the $Mo/CrO_3$ in the plating bath is increased, the molybdenum content of the Cr—Mo—I type alloy plating film increases.

Figure 3:
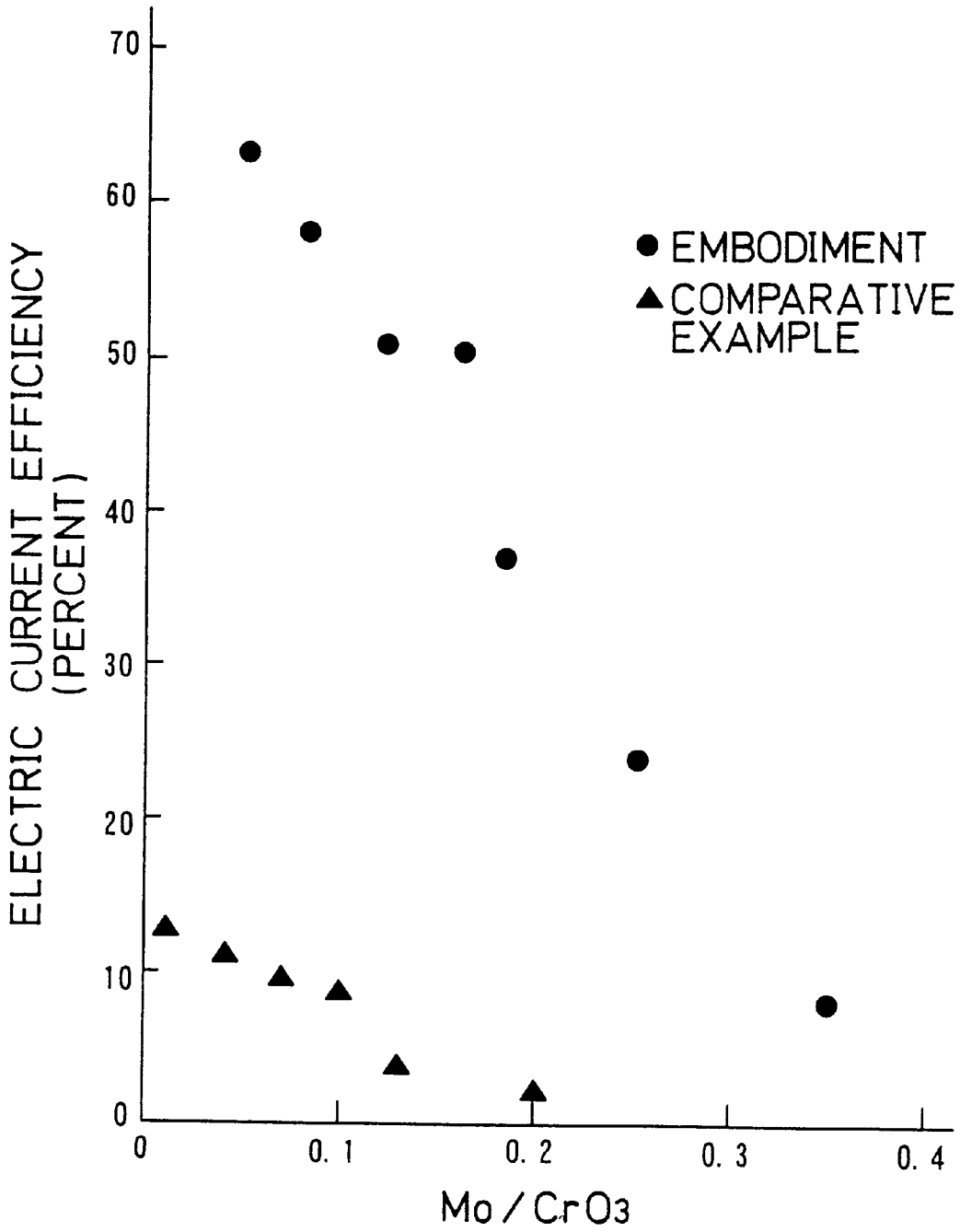
FIG. 3 is a graph showing electric current efficiency of the chromium alloy plating.

Next, Table 4 compares the electric current efficiency of the Cr—Mo—I type alloy plating (embodiment) with that of the Cr—Mo type alloy plating (comparative example) and the values are each plotted in the graph in FIG. 3.

The embodiment in Table 4 is based on the values in Table 3 and the comparative example is based on the data for sergent bath to which molybdate was added (The Journal of the Surface Finishing Society of Japan Vol. 21 (1970), No. 7, page 356).

TABLE 4

| | | | | | | | | |
|---|---|---|---|---|---|---|---|---|
| Comparative Example | $Mo/CrO_3$ weight ratio | 0.01 | 0.04 | 0.07 | 0.1 | 0.13 | 0.2 | — |
| | Electric current efficiency % | 12.7 | 11.1 | 9.7 | 8.7 | 3.9 | 2.1 | — |
| Embodiment | $Mo/CrO_3$ weight ratio | 0.05 | 0.08 | 0.12 | 0.16 | 0.18 | 0.25 | 0.35 |
| | Electric current efficiency % | 63.0 | 58.0 | 50.9 | 50.3 | 37.2 | 24.2 | 8.1 |

As FIG. 3 clearly shows, the Cr—Mo—I type alloy plating of this invention has high electric current efficiency compared to the Mo—Cr type alloy plating. Further, plating can be performed even when the $Mo/CrO_3$ has comparatively high values.

Figure 4:
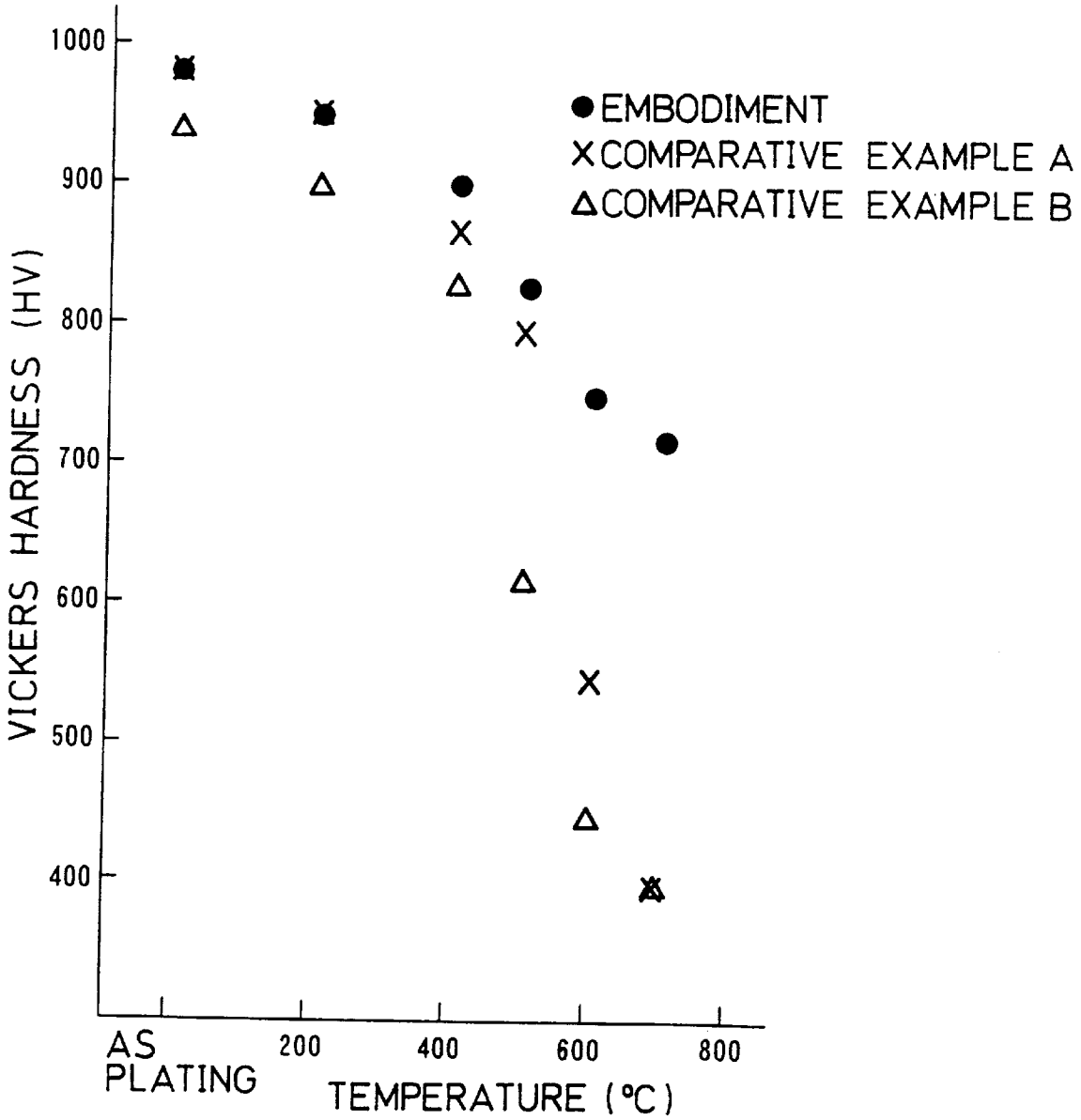
FIG. 4 is a graph showing results from the heat resistance test.

The Vickers hardness was next measured as plating and after heating for two hours at various temperatures in atmosphere. Table 5 shows the heat resistance ratings and the corresponding graph is shown in FIG. 4.

The plating film of the embodiment was an Cr—Mo—I type alloy plating film at 0.05 for the $Mo/CrO_3$ in Table 3.

The comparative example A was hard chromium plating using sergent bath. The comparative example B was hard chromium plating using fluoride plating bath. The plating conditions for these comparative examples are listed below.

| | Comparative example A | Comparative example B |
|---|---|---|
| $CrO_3$ | 250 g/l | 230 g/l |
| $H_2SO_4$ | 2.5 g/l | 1.2 g/l |
| $H_2SiF_6$ | — | 5 g/l |
| Plating temperature | 55° C. | 50° C. |
| Electric current density | 50 A/dm$^2$ | 50 A/dm$^2$ |

TABLE 5

| | Vickers Hardness HV | | |
|---|---|---|---|
| | Ernbodiment | Comparative Example A | Comparative Example B |
| As plating | 980 | 980 | 940 |
| 200° C. | 950 | 950 | 900 |
| 400° C. | 900 | 870 | 830 |
| 500° C. | 830 | 800 | 620 |
| 600° C. | 750 | 550 | 450 |
| 700° C. | 720 | 400 | 400 |

The hardness of both the comparative example A and the comparative example B decreases to about HV500 when heated at 600° C. as can be clearly seen in FIG. 4. However, the Cr—Mo—I type alloy plating of this invention maintains a high level of hardness even when heated to 600° C. or more.

Figure 5:
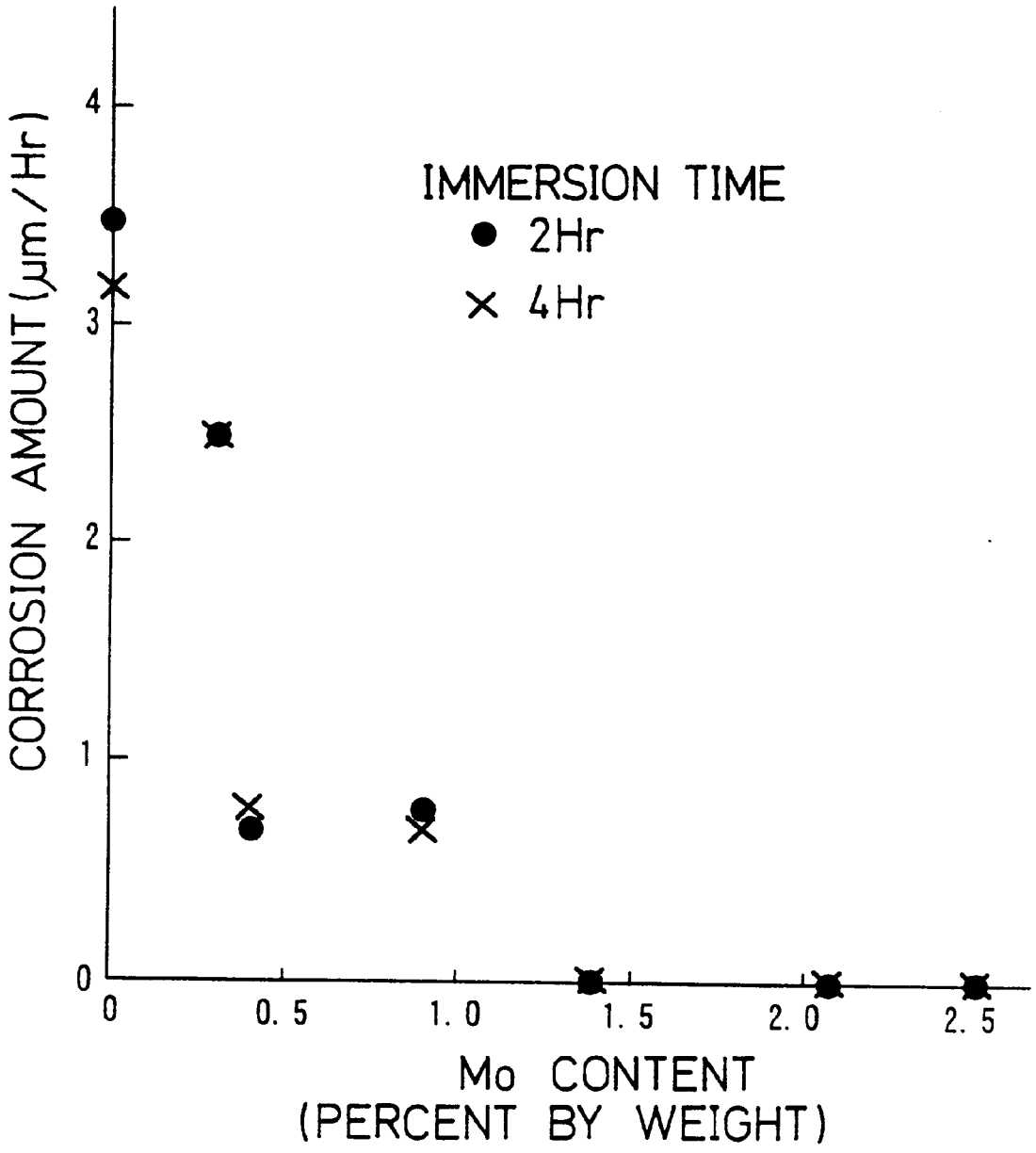
FIG. 5 is a graph showing results from the sulfuric acid corrosion resistance test.

The effect that the molybdenum content exerts on resistance to sulfuric acid corrosion in the chromium alloy plating film is shown in Table 6 and the corresponding graph is shown in FIG. 5.

The plating film used was the same as shown in Table 3. The resistance to sulfuric acid corrosion was tested by immersing the plated material in dilute sulfuric acid solution of 0.1% (PH1.5) at a bath temperature of 30° C. and then evaluated by the corrosion amount per hour ($\mu$m/Hr) after 2 hours and after 4 hours.

TABLE 6

| Molybdenum content in plating film | Corrosion amount $\mu$m/Hr | |
|---|---|---|
| wt % | 2 Hr | 4 Hr |
| 0 | 3.5 | 3.2 |
| 0.30 | 2.5 | 2.5 |
| 0.40 | 0.7 | 0.8 |
| 0.89 | 0.8 | 0.7 |
| 1.37 | 0 | 0 |
| 2.07 | 0 | 0 |
| 2.50 | 0 | 0 |

The resistance to sulfuric acid corrosion can be clearly seen to improve with an increase in the molybdenum content in the chromium alloy plating film as shown in FIG. 5. Extremely good resistance to sulfuric acid corrosion was obtained with a molybdenum content of 0.4 percent or more.

The test data from evaluation of the wear resistance of the Cr—Mo—I type alloy plating film of this invention by means of the reciprocating friction testing machine is explained next.

The plating conditions for the embodiments A and B, and the comparative example D were set per the above mentioned plating conditions (A) such that:

Embodiment A: $Na_2MoO_4.2H_2O$ 150 g/l

Embodiment B: $Na_2MoO_4.2H_2O$ 300 g/l

Comparative example D: $Na_2MoO_4.2H_2O$ 0 g/l with a plating temperature of 40° C., and an electric current density of 80 A/dm$^2$. The plating conditions for the comparative example C were the previously related fluoride plating bath type.

Figure 6:
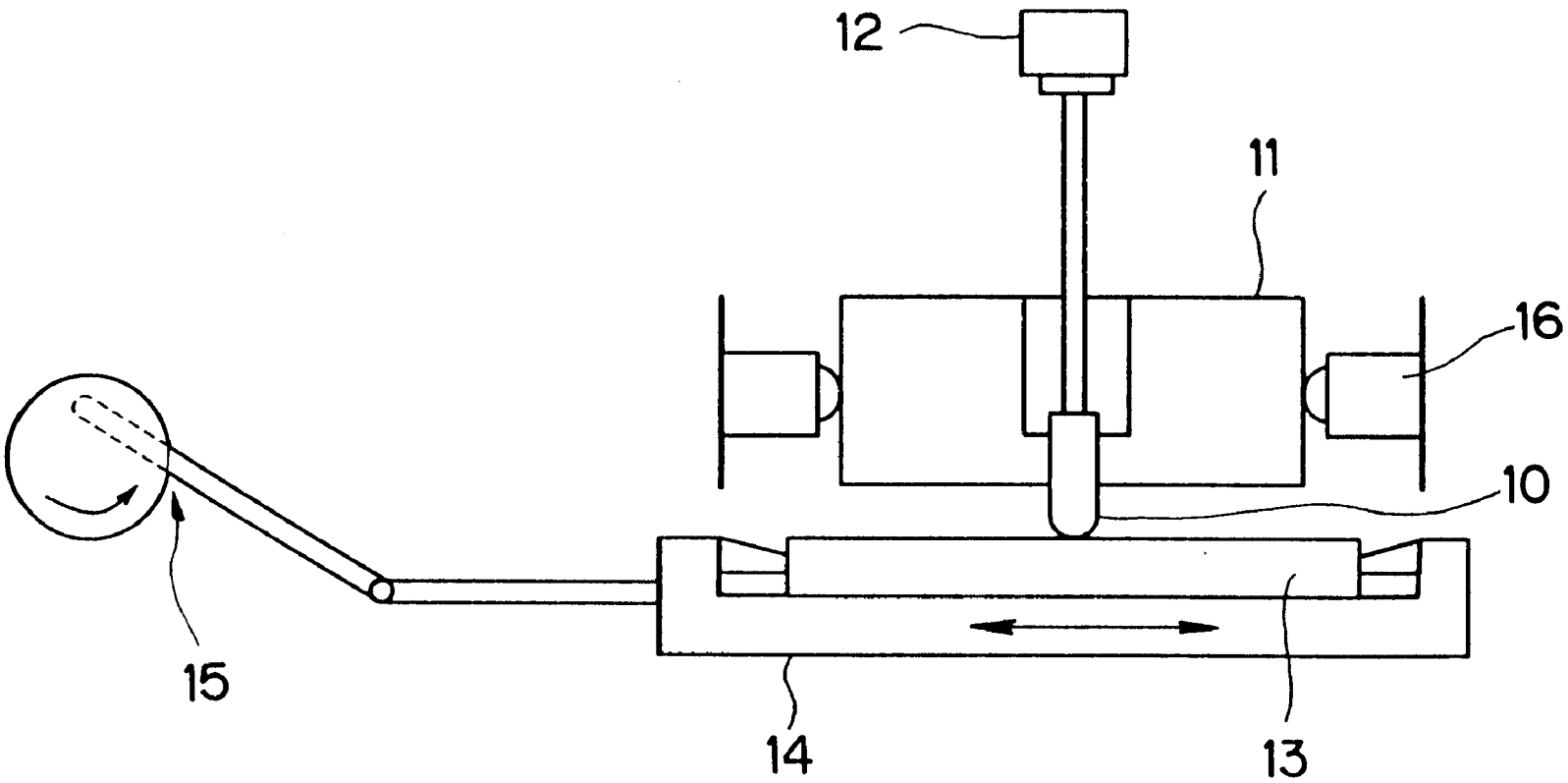
FIG. 6 is a drawing showing an outline of the reciprocating friction testing machine.

The test pieces covered with the above mentioned four types of films were manufactured and testing was performed with the reciprocating friction testing machine. FIG. 6 shows an outline of the reciprocating friction testing machine used in the test. A pin-shaped upper test piece 10 is supported by a fixed block 11. A downward load is applied to the upper test piece 10 from above by a hydraulic cylinder 12 and the upper test piece 10 is pressed against a lower test piece 13. The flat base shaped lower test piece 13 is supported by a movable block 14 and moved back and forth by a crank mechanism 15. The numeral 16 denotes a load cell.

Test conditions were as follows.

Break-In Conditions

Load: 2 kgf

Reciprocating speed: 100 cpm

Time: 5 minutes

Wear Conditions

Load: 10 kgf

Reciprocating speed: 600 cpm

Time: 60 minutes

Lubrication Conditions

Bearing oil with viscosity equivalent to light oil (JH2)

Sliding Mating Material: Lower Test Piece

Boron cast iron for cylinder liner

The amount of wear (in $\mu$m) measured on the film after testing with the reciprocating friction testing machine is shown in Table 7. The heat treatment in the table was the following. The test pieces after plating were heated for two hours at 300° C. in the atmosphere and then air-cooled.

TABLE 7

| | | Wear amount $\mu$m | | | |
|---|---|---|---|---|---|
| | | No Heat Treatment | | Heat Treatment | |
| | Mo wt % | Upper test piece | Lower test piece | Upper test piece | Lower test piece |
| Embodiment A | 0.89 | 3.3 | 2.4 | 3.1 | 2.3 |
| Embodiment B | 2.07 | 3.6 | 2.3 | 3.7 | 2.5 |
| Comparative Example C | 0 | 3.8 | 2.5 | 4.3 | 2.7 |
| Comparative Example D | 0 | 4.7 | 2.6 | 6.5 | 3.5 |

Figure 7:
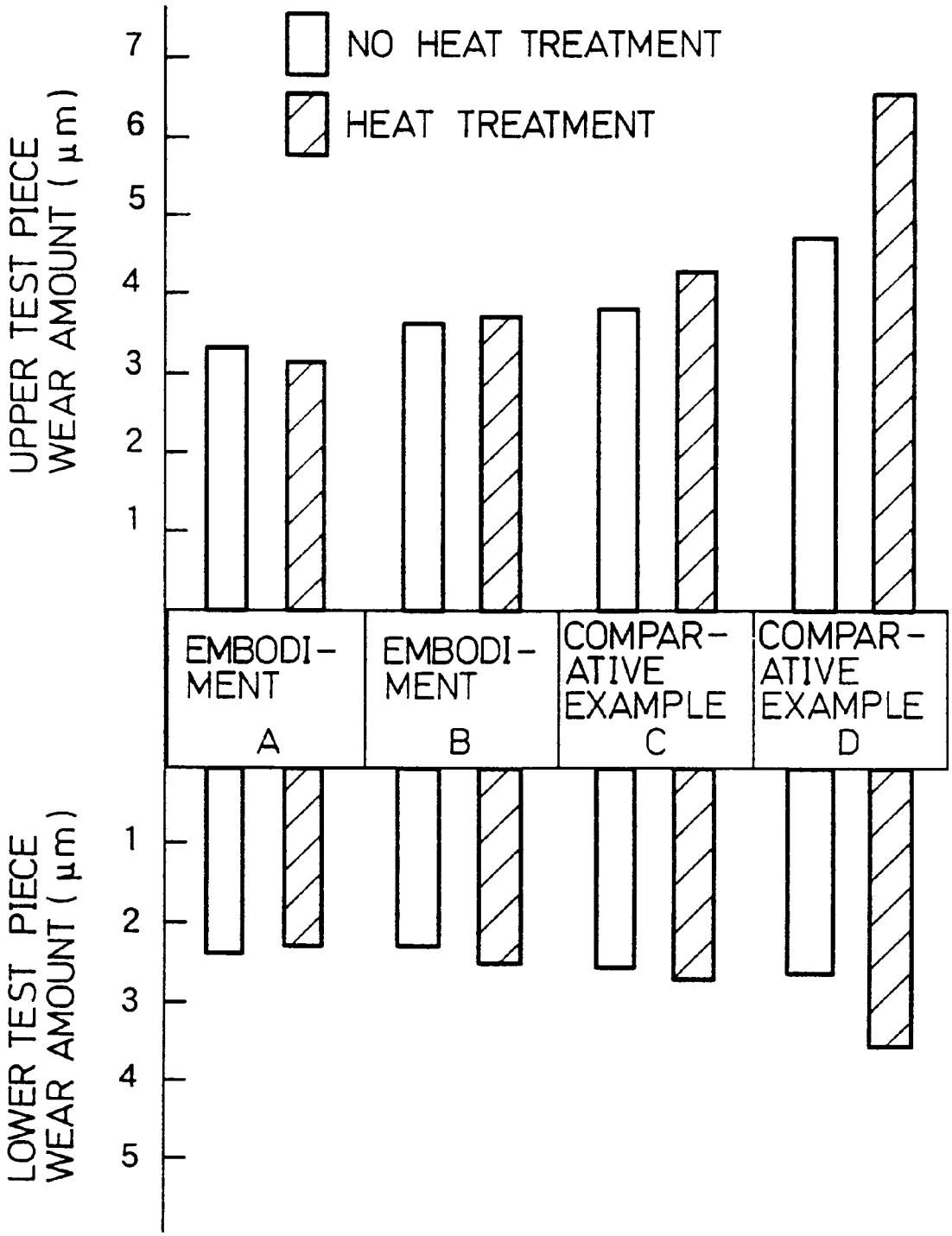
FIG. 7 is a graph showing results from the wear test.

As shown in FIG. 7, in the films of the embodiments A and B, self-wear and wear on the mating material are little. There is also almost no increase in wear due to the heat treatment.

The Cr—Mo—I type alloy plating film of this invention is ideal as a covering on sliding members and corrosion resistant members. In other words, the film of this invention can be utilized to cover the sliding surfaces of sliding members such as composing parts (cylinder liners and piston rings, etc.) in internal combustion engines or the surfaces where resistance to corrosion is required on corrosion resistant members such as marine or ship parts.

Figure 8:
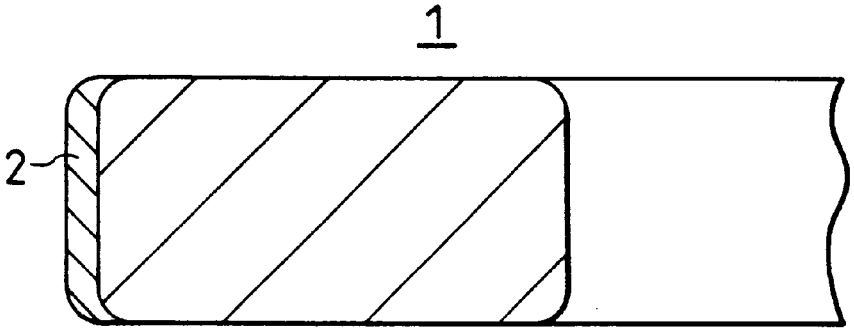
FIG. 8 is a longitudinal cross sectional view showing a portion of the piston ring.

FIG. 8 shows a piston ring as one example of a sliding member. The outer circumferential surface of a piston ring 1 is covered with a Cr—Mo—I type alloy plating film 2 of this invention.

Figure 9:
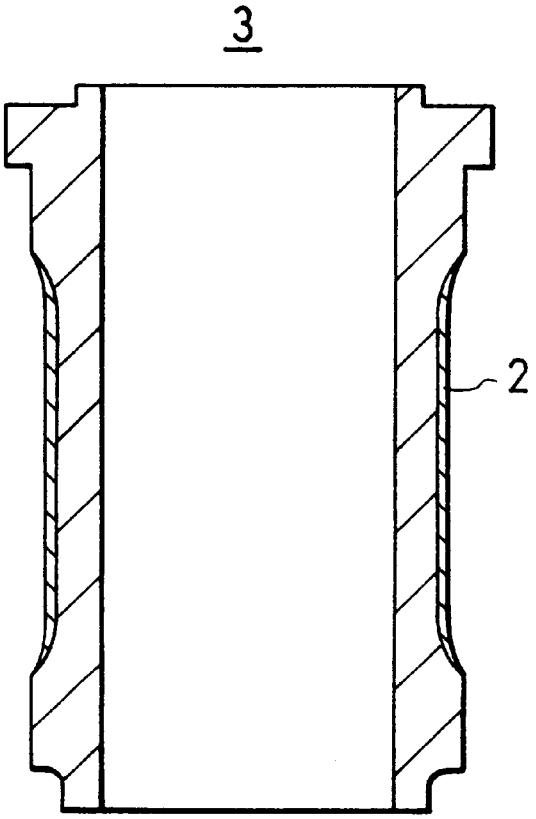
FIG. 9 is a longitudinal cross sectional view showing the cylinder liner.

FIG. 9 shows a cylinder liner as one example of a corrosion resistant member. The water jacket on the outer circumferential surface of a cylinder liner 3 in other words the portion making contact with the cooling water (sea water) is covered with the Cr—Mo—I type alloy plating film 2 of this invention.

The above described chromium alloy plating film of this invention, because of superior high heat resistance, wear resistance and corrosion resistance, can be utilized on sliding members and corrosion resistant members on which conventional hard chromium plating cannot be used. Moreover, the chromium alloy plating of this invention has the important advantage of high electric current efficiency.

Although the present invention has been described with reference to the preferred embodiments, it is apparent that the present invention is not limited to the aforesaid preferred embodiments, but various modification can be attained without departing from its scope.

What is claimed is:

1. A chromium alloy plating film containing iodine in 0.1 to 1.4 percent by weight and molybdenum in 0.4 to 3.8 percent by weight.

2. A sliding member covered on a sliding surface with said chromium alloy plating film of claim 1.

3. A corrosion resistant member covered on a surface where resistance to corrosion is required with said chromium alloy plating film of claim 1.

* * * * *